US006758247B2

(12) United States Patent
Thieme

(10) Patent No.: US 6,758,247 B2
(45) Date of Patent: Jul. 6, 2004

(54) ARRANGEMENT FOR BINDING AN OBJECT, IN PARTICULAR CABLE HARNESS

(75) Inventor: Hans-Dieter Thieme, Uetersen (DE)

(73) Assignee: Hellermann Tyton GmbH, Tornesch (DE)

( * ) Notice: Subject to any disclaimer, the term of this patent is extended or adjusted under 35 U.S.C. 154(b) by 0 days.

(21) Appl. No.: 10/074,323

(22) Filed: Feb. 12, 2002

(65) Prior Publication Data

US 2002/0108668 A1 Aug. 15, 2002

(30) Foreign Application Priority Data

Feb. 12, 2001 (EP) ..... 01103242

(51) Int. Cl.[7] ..... B21F 9/02
(52) U.S. Cl. ..... 140/123.6; 140/93.2
(58) Field of Search ..... 140/93 A, 93.2, 140/93.4, 123.6, 123.5

(56) References Cited

U.S. PATENT DOCUMENTS 5,351,386 A * 10/1994 Chang ..... 140/93.2

FOREIGN PATENT DOCUMENTS

EP 0 297 337 A1 1/1989

* cited by examiner

*Primary Examiner*—Lowell A. Larson
(74) *Attorney, Agent, or Firm*—Alix, Yale & Ristas, LLP

(57) ABSTRACT

The invention relates to an arrangement for binding an object, in particular a cable harness, having a tool, a band (9) and a lock (2), the band (9) being guided, in the form of a loop, through the lock (2), which has a band passage (23) and detents (21) arranged therein and engaging in the band (9), the tool having a clamp and a band guide (7), which opens out into a lock mount (5) on an end side of the tool, and also having a movable covering tongue (6), which temporarily prevents at least one of the detents (21) from engaging in the band (9), the covering tongue (6) being mounted in a pivotable manner. The covering tongue (6) is expediently arranged such that, in a deflected position, it projects into the band passage (23) of the lock (2) in the lock mount (5).

20 Claims, 3 Drawing Sheets

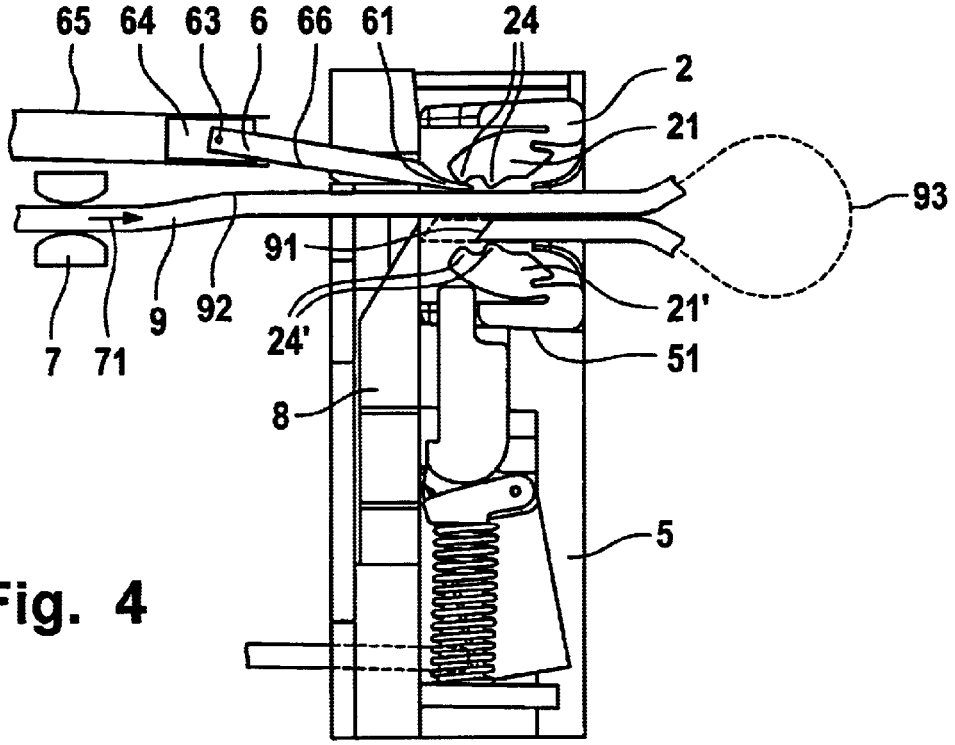
Fig. 4
Fig. 5
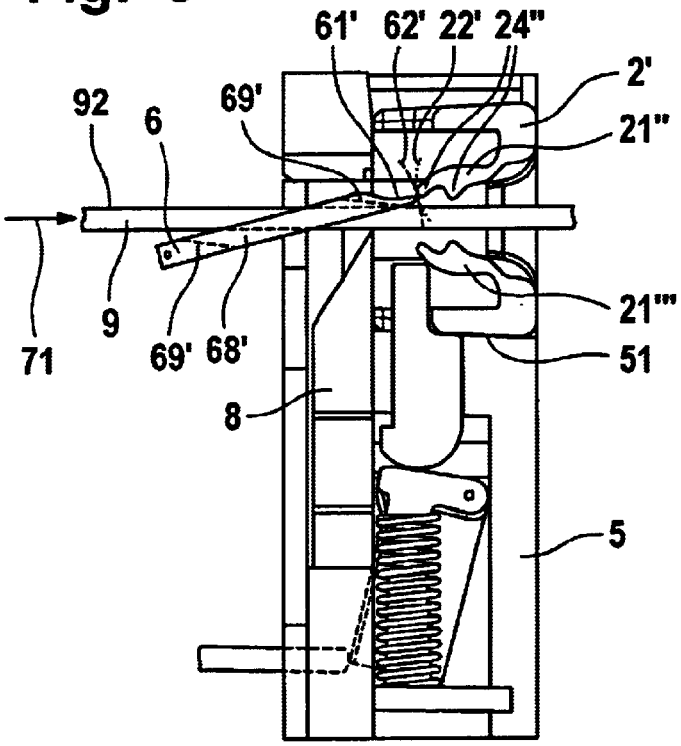
Fig. 6
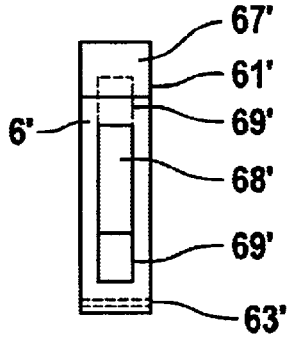

ARRANGEMENT FOR BINDING AN OBJECT, IN PARTICULAR CABLE HARNESS

BACKGROUND OF THE INVENTION

The invention relates to an arrangement for binding an object, in particular a cable harness, having a tool, a band and a lock, the band being guided, in the form of a loop, through the lock, which has a band passage and detents arranged therein and engaging in the band, the tool having a clamp and a band guide, which opens out into a lock mount on an end side of the tool, and also having a movable covering tongue, which temporarily prevents at least one of the detents from engaging in the band.

An arrangement of this type is known from U.S. Pat. No. 4,908,911. This document describes, in particular, a tool for binding a band retained by a lock. The tool has a tool housing, at the front end of which a clamp is arranged. Provided in the tool housing is a band guide, along which the band is advanced from a magazine, through the housing, toward and through the clamp, and a lock channel, through which the locks are guided to a lock mount. The lock mount is arranged at the clamp-side mouth of the band guide. During operation, a lock is brought into the lock mount via the lock channel, and the band is then advanced from the band guide, through the lock in the lock mount, into the clamp and guided, as a loop, around the object which is to be bound. The free band end is then guided, through the lock, into the tool again in order then to tension the band. The band loop is kept taut by the lock and can be removed from the tool once the band has been severed. In order for it to be possible to prevent release of the band loop from the lock, the latter has detents for securing the band. In order that the band nevertheless can run through the lock without obstruction during advancement, a covering tongue is provided, it being possible for said tongue to be introduced into the region between the band and detents in order to prevent the detents of the lock from engaging in a toothing formation of the band, and thus to prevent the band advancement from being obstructed. The covering tongue is guided in a longitudinally displaceable manner by means of a carriage and, at its tip, has a wedge in order thus to raise off one of the detents from the band and so to prevent it from engaging in the toothing formation of the latter. The known arrangement, however, is disadvantageous in terms of reliability and versatility. The tool is sensitive to differences in the position of the lock and/or of the detent relative to the covering tongue. This is because, if the lock is not located in its ideal position, then it may be the case that, when it is introduced into the lock, the covering tongue, rather than gripping beneath the detent by way of its wedge tip and thus raising said detent, it runs against the front of the detent and, in the process, either blocks or damages or destroys the detent. This results in the tool coming to an undesired standstill. The same problem also arises when different locks with differently arranged detents are to be used for different band thicknesses. In this case, the tool has to be laboriously adapted every time to the lock which is used in each case, with its arrangement of the detent, in order to avoid disruption.

The object of the invention is to increase the reliability and variability of such an arrangement.

SUMMARY OF THE INVENTION

In the case of an arrangement for binding an object, in particular a cable harness, having a tool, a band and a lock, the band being guided, in the form of a loop, through the lock, which has a band passage and detents arranged therein and engaging in the band, the tool having a clamp and a band guide, which opens out into a lock mount an end side of the tool, and also having a movable covering tongue, which temporarily prevents at least one of the detents from engaging in the band, the invention provides that the covering tongue is mounted in a pivotable manner.

The pivotable mounting according to the invention gives the covering tongue an additional degree of freedom, which allows adaptation to different positions of the detents in the case of different locks. When it is introduced into the lock, the covering tongue may be deflected to the extent where, in the case of all expected locks together with their detents, reliable gripping beneath the detent can take place. This ensures reliable gripping of the detents even in the case of the detents unavoidably having different positions, as a result of tolerances, within the same type of lock. The pivotable mounting of the covering tongue makes it possible for there to be no need for this covering tongue, when it is introduced into the lock, to have any direct contact with the detent; rather, it may be introduced at a safe distance from the detents.

The covering tongue can preferably be pivoted about a pin which is located perpendicularly to a band-guiding direction. This has the advantage that the pivot pin of the covering tongue is approximately parallel to the axis or the axes about which the detent or detents of the lock move; the axis of the detent, to be more precise that of the center of rotation about which the detent moves, is likewise usually located perpendicularly to the band-advancement direction. The paths on which the covering tongue, on the one hand, and the detent, on the other hand, move are then located in one plane. This makes it possible for the detent to be raised by the covering tongue in a harmonious manner.

The pivot pin of the covering tongue is preferably arranged such that a movement path of the covering tongue intersects a movement path of the detent at an acute angle.

The surface of the covering tongue which is intended for abutment against the detent of the lock is expediently of grooved design. This has the advantage that, on the one hand, the covering tongue can easily be pushed into the region beneath the detent and, on the other hand, it is easily possible to accommodate relative movements between the detent and covering tongue, in particular in the direction of one another, which are produced when the detent is raised.

The pivoting of the covering tongue may be effected actively or passively. If it is effected actively, a dedicated drive is expediently provided for the covering tongue. If it is effected passively, the covering tongue is expediently arranged such that, in the pivoted-out state, it projects into the region provided on the lock for band-passage purposes. If the band is advanced out of the tool body, through the lock, in the direction of the clamp, it comes into contact with the covering tongue and forces the latter out of the band-guiding region, as a result of which the covering tongue is made to pivot.

The covering tongue is preferably arranged in a longitudinally displaceable manner between a position in which it is advanced into the lock mount and a position in which it is retracted therefrom. By combining the pivoting movement according to the invention with the longitudinal movement, it is possible to improve and simplify the actuation of the covering tongue. It is thus possible, in particular, for the covering tongue to be drawn out by straightforward longitudinal displacement. Longitudinal displacement here, rather than being understood just as a linear movement, may be any desired, e.g. circular, movement with a sufficient longitudinal component. It is particularly advantageous for the covering tongue to be arranged, for this purpose, on an eccentric. This makes possible, in an extremely straightforward manner, both a pivoting movement and a longitudinal movement.

An actuating device is expediently provided for the covering tongue and is controlled such that the covering tongue is advanced when the clamp is closed and retracted when the clamp is open. It is thus possible, in an outlay-reducing manner, for the covering tongue to be linked to the actuation of the clamp, if appropriate by means of the eccentric.

BRIEF DESCRIPTION OF THE DRAWING

The invention is explained hereinbelow with reference to the drawing, in which advantageous exemplary embodiments of the invention are illustrated and in which:

FIG. 4 shows a view corresponding to FIG. 2 with the covering tongue pivoted in to the full extent;

FIG. 5 shows an enlarged view of a part corresponding to FIG. 3 with an arrangement according to a second exemplary embodiment of the invention; and FIG. 6 shows a plan view of the covering tongue according to FIG. 5.

DETAILED DESCRIPTION OF THE PREFERRED EMBODIMENTS

The arrangement according to the invention comprises a tool 1, a band 9 and at least one lock 2. By means of the tool 1, the band 9 is guided, in a loop, around an object which is to be bound, for example a bundle of cables 99, and the respective ends of the band loop are retained by the lock 2.

Figure 1:
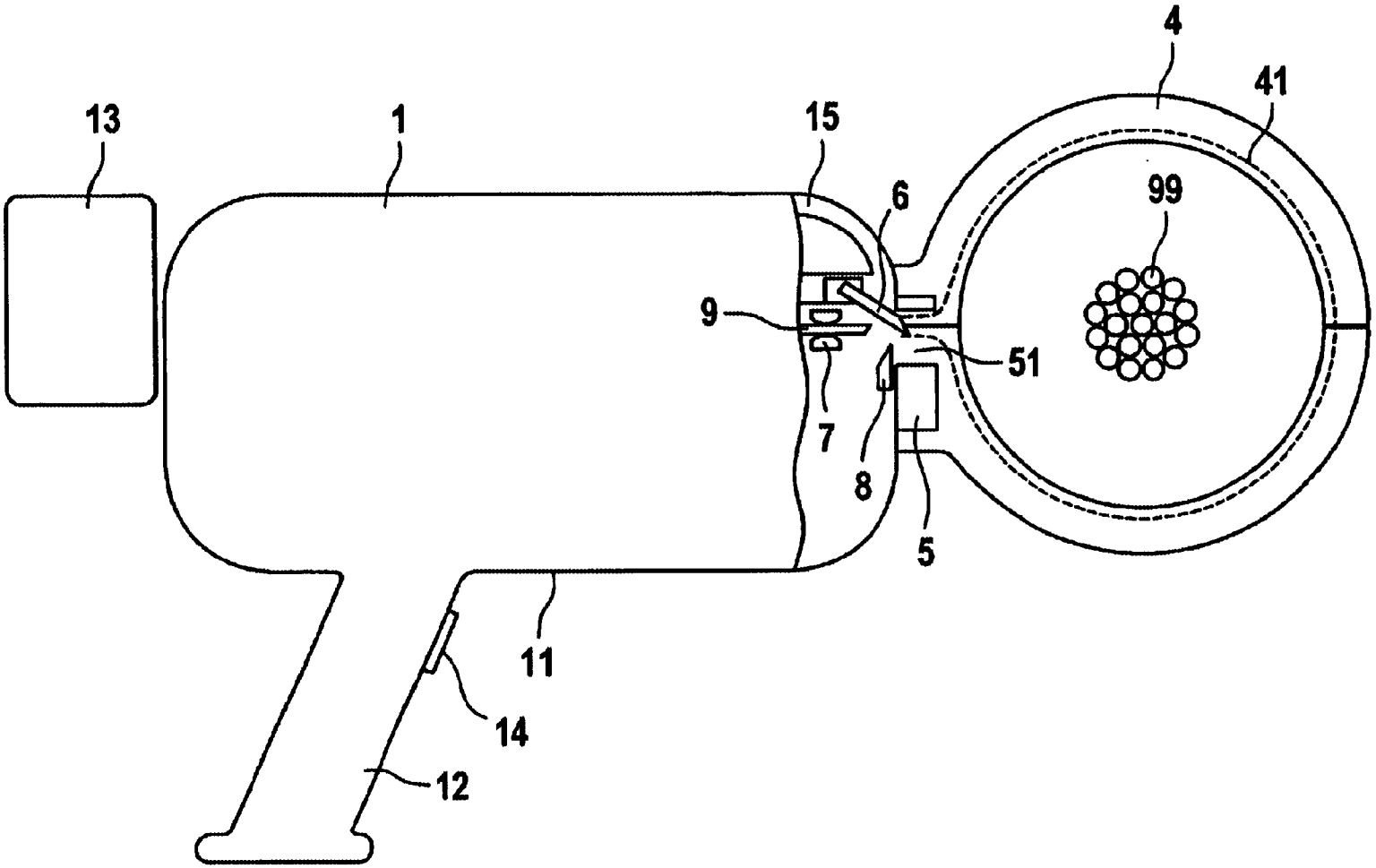
FIG. 1 shows a side view of an arrangement according to a first exemplary embodiment of the invention, partly in section.

The tool 1 has an elongate tool body 11 on which is arranged a gun-like handle 12 with an actuating switch 14. In a rear region of the tool 1, a band magazine 13 is fitted on the tool body 11. The band magazine 13 need not necessarily be arranged directly on the tool body 11; it is also possible for it to be arranged separately, in which case the band material is fed via a connecting line. Such a configuration is recommended, in particular, for large magazines. In its interior, the tool body 11 has a band guide 7, of which it is possible to see a front end in the partially sectioned region of FIG. 1. Likewise located within the tool body 11, or outside in a separate, large magazine (not illustrated), is a supply of locks 2, which are fed, via a lock channel, to a lock mount 5 arranged at the front end of the tool body 11. The lock mount 5 has a cavity 51 for accommodating one of the locks 2. The band guide 7 within the tool body 11 opens out, on the tool side of the lock mount 5, approximately in the center of the accommodating space 51, the band-guiding groove 41 of the clamp 4 adjoining the mouth of the band guide 7 in an aligned manner. Also arranged on the lock mount 5, on the tool side, is a cutting blade 8 for severing the band 9.

Figure 2:
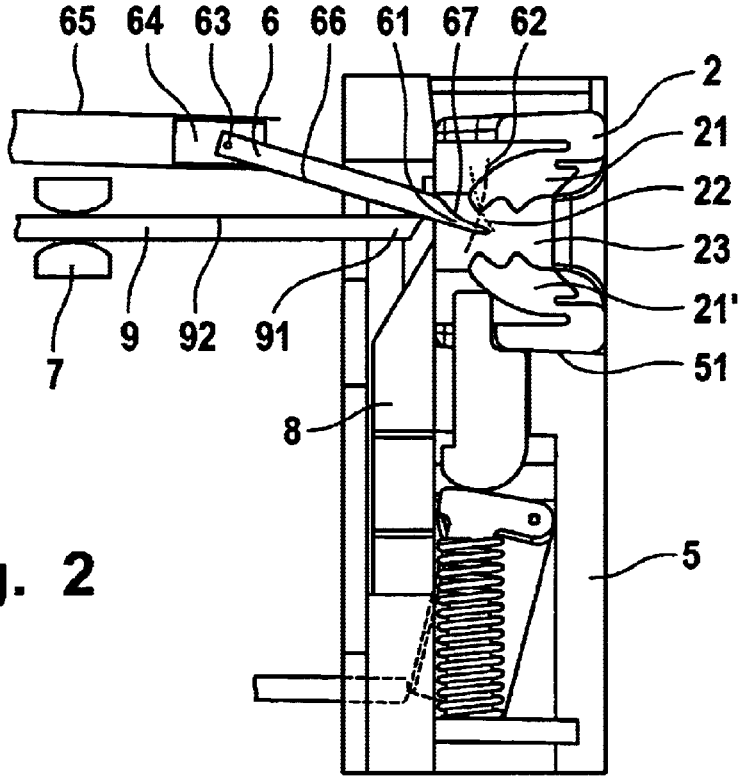
FIG. 2 shows an enlarged view of part of FIG. 1 with the covering tongue in the pivoted-out position.

An enlarged and more precise illustration of the region of the tool 1 around the lock mount 5, the band guide 7 and the covering tongue 6 is illustrated in FIG. 2. The illustration here shows a configuration at the beginning of a binding operation. The band 9 is guided in the band guide 7. Its leading band end 91 is located, as a result of the preceding severing operation, in the region of the blade 8.

The covering tongue 6 is arranged above the band guide 7. It is connected, via a pivot bearing 63, to a carriage 64 which is guided in a longitudinally displaceable manner in a guide 65. In the region of its tip 61, the band tongue rests on the leading band end 91, to be precise such that it is in contact with the leading band end by way of its underside 66. On its top side, the covering tongue 6 has a groove formation 67 in the region of its tip 61. FIG. 2 illustrates the covering tongue in its advanced position, in which it projects into the lock-accommodating space 51 by way of its tip 61. During the pivoting operation, it moves approximately over a path illustrated by a dashed line 62.

The lock 2 is located in the accommodating space 51 of the lock mount 5. It has a band passage 23 in its center. Two detents 21 are located opposite one another in the passage. The detents 21 are connected to the lock 2 on the lock side, on which the band loop is located following a binding operation. The detents 21 extend away from the band-loop side of the lock 2 into the band passage 23. At their outer end, they each have two latching noses 24, which are arranged parallel to one another on a surface of the detent 21 which is directed toward the respectively other latching nose 24 in each case. The latching noses 24 are designed for engaging in a toothing formation (not illustrated) on one of the outer sides 92 of the band 9. The clear distance between the detents 21 is dimensioned such that it is greater than a single thickness of the band 9, but smaller than double the thickness of the band 9; the lower limit, however, is not definitive, it also being possible for the clear distance to be smaller than the thickness of the band 9. With the detents 21 deflected, the outer of the latching teeth 24 moves approximately over a path illustrated by a dotted line 22.

The arrangement is operated as follows: at the beginning of a binding operation, a lock 2 is fed into the accommodating space 51 of the lock mount 5. The band 9 is still located in the band guide 7 from a preceding binding operation, the band end 91 being located in the region of the blade 8. The covering tongue 6 is located in its advanced and pivoted-out position. Depending on the thickness of the band 9, the pivoted-out position has not been reached to the full extent. This state is illustrated in FIG. 2.

Figure 3:
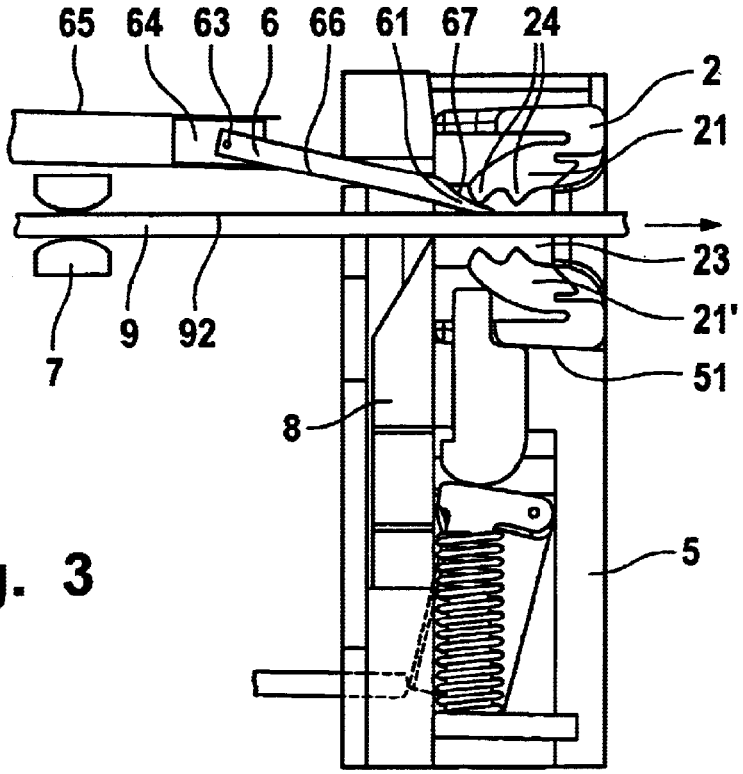
FIG. 3 shows a view corresponding to FIG. 2 with the covering tongue pivoted in to some extent.

The actual binding operation begins, and the clamp 4 is closed around the cable harness which is to be bound. The band 9 is moved via the band guide 7 in the advancement direction 71 in a manner known per se. In this case, the leading band end 91 passes through the band passage 23 of the lock 2 and passes into the band-guiding groove 41 of the clamp 4 in an aligned manner. The band 9 deflects the covering tongue by way of its outer side 92, which butts against the rear side 66 of the covering tongue 6, with the result that said covering tongue is pivoted (upward in the illustration) into its partially pivoted-in position. The covering tongue 6 grips beneath the top detent 21 by way of its tip 61, the groove formation 67 coming into abutment against the outer latching tooth 24 of the detent and covering the same. The detent 21 is thus spread somewhat apart from the band 9 and consequently prevents the latching teeth 24 from engaging in the toothing formation on the rear side 92 of the band 9. Although the covering tongue 6 only covers the outer of the two latching teeth 24, this is sufficient to prevent the two latching teeth 24 from engaging in the toothing formation of the band 9. This state is illustrated in FIG. 3.

When the band 9 has run through the clamp 4 during its movement in the advancement direction 71, it passes into the band passage 23 of the lock 2 again, from the clamp side, with its leading band end 91 in front. The outer band end 91 here runs parallel, but in the opposite direction, to the advancement direction 71 of the rest of the band 9. When the band end 91 here passes into the region of the detents 21, the two latching teeth 24 are spread apart since, in the non-spread-apart state, the clear distance is not sufficient for the thickness of two bands. In this case, the rear side 92 of the band 9 comes into contact with the latching teeth 24 of the bottom detent 21', i.e. the latching teeth 24 engage in the toothing formation which is provided on the rear side 92. This is usually not disruptive since in this direction, which is also referred to as the tensioning direction, a movement of the band tip 91 is not obstructed by the detent 21' (although probably is in the opposite direction). In the case of that other part of the band 9 which is moving in the advancement direction, engagement of the latching teeth 24 in the toothing formation on the outer side 92, however, would obstruct the movement. However, by way of its tip 61, which is located between the outer latching tooth 24 and the rear side 92 of the band, the covering tongue prevents the latching teeth 24 from engaging in the toothing formation on the rear side 92. The movement of the band is thus not obstructed by the detent 21. This state is illustrated in FIG. 4.

Since the covering tongue 6 prevents the latching teeth 24 from engaging in the toothing formation of the rear side 92, the band 9 may be pushed further until, finally, the band tip reaches the position illustrated by dashed lines in FIG. 4, in which it butts against the blade 8. The blade 8 functions as a stop for the band tip 91. The advancement movement of the band 9 is thus completed. The covering tongue 6 can be drawn out of the region between the band 9 and the detent 21. The detent 21 thus engages in the toothing formation provided on the rear side 92 of the band 9 and prevents the band 9 from moving further in the direction of the clamp. Once the band has been tensioned, the band 9 is then severed by means of the blade 8. By virtue of the detents 21 of the lock 2, the loop 93 formed around the bundle of cables 99 by the band 9 is maintained since a release-inducing movement of the band in the direction of the loop is prevented by the detents 21 of the lock 2.

As can best be seen in FIG. 2, the path 22 of the detent 21 during the spreading operation and the movement path 62 of the covering tongue 6 intersect at an acute angle. In the example illustrated, the angle is approximately 25°. It is not absolutely necessary, however, for the acute angle to be of such a magnitude, although it is preferably smaller than 60°, further preferably smaller than 45°, and even further preferably smaller than 20°. This acute angle achieves the situation where the tip 61 of the covering tongue 6, during the pivoting movement thereof, is only displaced to a slight extent, if at all, relative to the detent 21. Such displacement would be disadvantageous since, as a result of the horizontal movement occurring here between the covering tongue 6 and latching nose 24, the latching nose would be abraded in an uncontrolled manner, as a result of which the secure connection would be impaired.

In the exemplary embodiment illustrated, the covering tongue 6 is only provided on one side and only acts on the detent 21, against which the band 9 butts by way of its toothed side 92 during its advancement movement. It goes without saying that it is also possible to provide more than one covering tongue 6, in order to cover further detents.

In the exemplary embodiment illustrated in FIG. 5, the covering tongue 6' is arranged in a pivotable manner beneath the band 9. In its central region, the covering tongue has an opening 68' through which the band 9 is guided. Bevels 69' are provided in each case at the bearing end and at the tip end of the opening 68'. The tip 61' of the covering tongue moves, during the pivoting operation, over the path illustrated by a dashed line 62'. A lock 2' is accommodated in the accommodating space 51 of the tool, the dimensions of said lock differing from those of the lock 2. For example, its detents 21", 21'" are less bulky than the detents 21, 21' of the lock 2. An outer latching tooth 24" of the detent 21" moves, during the spreading operation, along a path illustrated by a dotted line 22".

In the state illustrated in FIG. 5, the band 9 extends through the opening 68' of the covering tongue 6', out of the tool body 1, to the clamp 4, and the tip 61' of the covering tongue grips just beneath the outer latching tooth 24" of the detent 21". In this case, the covering tongue 6' rests on the toothed side 92 of the band by way of its tip-side bevel 69'. As a result, the band 9 pivots the covering tongue, by way of its tooth side 92, to the extent that the latching teeth 24" of the detent 21" are raised off from the band 9. The band 9 can run freely through the lock 2'. When the band tip 91 re-enters following the formation of the loop, that part of the band 9 which is moving in the advancement direction is forced upward in the direction of the detent 21". In this case, the band causes further pivoting of the covering tongue 6', the tip 61' of the latter, which grips beneath the latching tooth 24", raising off the detent 21" from the band 9, with the result that the latching teeth 24" are prevented from engaging in the band 9. The band 9 can thus be advanced further until it has reached its end position, with the tip 91 butting against the blade 8. In order that the covering tongue 6' finally releases the detent 21", and thus allows the band 9 to engage, and be retained, in the lock 2', the covering tongue 6' is pivoted further upward along its path 62' until it has been moved away from the detent 21", moving over its path 22', to the extent where the detent 21" is released, snaps back in the direction of the band 9 and engages in the toothed side 92 by way of its latching teeth in order thus to prevent the band 9 from moving in the direction 71. It is not necessary in this embodiment for the covering tongue 6' to be mounted in a longitudinally displaceable manner.

What is claimed is:

1. An arrangement for binding an object, comprising a tool, a band and a lock, the band being guided, in the form of a loop, through the lock, which has a band passage and detents arranged therein and engaging in the band, the tool having a clamp and a band guide, which opens out into a lock mount on an end side of the tool, and also having a pivotably attached covering tongue, which temporarily prevents at least one of the detents from engaging in the band.

2. The arrangement as claimed in claim 1, wherein the covering tongue can be pivoted about a pin which is perpendicular to a band-guiding direction.

3. The arrangement as claimed in claim 2, wherein the pivot pin of the covering tongue is arranged such that a movement path of the covering tongue intersected a movement path of the detent at an acute angle.

4. The arrangement as claimed in claim 3, wherein, in its pivoted-out position, the covering tongue projects into the band passage of the lock.

5. The arrangement as claimed in claim 3, wherein the covering tongue is guided in a longitudinally displaceable manner in a guide.

6. The arrangement as claimed in claim 3, wherein the covering tongue is arranged on an eccentric.

7. The arrangement as claimed in claim 2, wherein the pivot pin of the covering tongue is arranged such that a movement path of the covering tongue intersects a movement path of the detent at an acute angle.

8. The arrangement as claimed in claim 7, wherein, in its pivoted-out position, the covering tongue projects into the band passage of the lock.

9. The arrangement as claimed in claim 7, wherein the covering tongue is guided in a longitudinally displaceable manner in a guide.

10. The arrangement as claimed in claim 9, wherein the covering tongue is arranged on an eccentric.

11. The arrangement as claimed in claim 2, wherein, in its pivoted-out position, the covering tongue projects into the band passage of the lock.

12. The arrangement as claimed in claim 2, wherein the covering tongue is guided in a longitudinally displaceable manner in a guide.

13. The arrangement as claimed in claim 2, wherein the covering tongue is arranged on an eccentric.

14. The arrangement as claimed in claim 1, wherein, in its pivoted-out position, the covering tongue projects into the band passage of the lock.

15. The arrangement as claimed in claim 4, wherein the covering tongue is arranged on an eccentric.

16. The arrangement as claimed in claim 1, wherein the covering tongue is guided in a longitudinally displaceable manner in a guide.

17. The arrangement as claimed in claim 5, wherein the covering tongue is arranged on an eccentric.

18. The arrangement as claimed in claim 1, wherein the covering tongue is arranged on an eccentric.

19. The arrangement as claimed in claim 1, characterized in that an actuating device is provided for the covering tongue and is controlled such that the covering tongue is advanced when the clamp is closed and retracted when the clamp is open.

20. The arrangement as claimed in claim 1, wherein a surface of the covering tongue, which is intended for abutment against the detent, is of grooved design.

* * * * *